United States Patent [19]

Janicz

[11] 4,370,373

[45] Jan. 25, 1983

[54] FLEXIBLE EDGING OF DESKS

[75] Inventor: Thomas H. Janicz, Haverford, Pa.

[73] Assignee: Burlington Industries, Inc., Greensboro, N.C.

[21] Appl. No.: 169,742

[22] Filed: Jul. 17, 1980

[51] Int. Cl.[3] ..... B32B 3/02; B32B 5/18

[52] U.S. Cl. ..... 428/151; 52/717; 248/345.1; 428/174; 428/308.4; 428/318.4; 428/318.8; 428/319.1; 428/319.3

[58] Field of Search ..... 428/174, 151, 218, 310, 428/315, 308.4, 318.4, 12, 318.8, 319.1, 319.3; 229/DIG. 1; 248/345.1; 273/9; 52/717, 718; 411/508-510; D6/269; 293/142

[56] References Cited

U.S. PATENT DOCUMENTS

| | | | |
|---|---|---|---|
| 1,911,649 | 5/1933 | Schlegel | 428/123 |
| 2,193,719 | 3/1940 | Foote | 45/137 |
| 3,077,251 | 2/1963 | Fraylick et al. | 52/718 |
| 3,330,559 | 7/1967 | Fischer et al. | 273/9 |
| 3,627,251 | 12/1971 | Peullson | 248/345.1 |
| 3,634,925 | 1/1972 | Van Loo | 248/345.1 |
| 3,669,484 | 6/1972 | Bernitz | 293/142 |
| 3,869,106 | 3/1975 | Gregov | 248/345.1 |
| 3,907,624 | 9/1975 | Gravely, Jr. | 156/214 |
| 3,922,429 | 11/1975 | Welch et al. | 428/308.4 |
| 4,109,887 | 8/1978 | Wakeland, Jr. | 248/345.1 |
| 4,164,526 | 8/1979 | Clay | 428/151 |

*Primary Examiner*—Paul J. Thibodeau

*Attorney, Agent, or Firm*—Cushman, Darby & Cushman

[57] ABSTRACT

A method of edging a piece of furniture, such as a desk, and assemblies utilizing such edging are provided. Normal impact forces are absorbed by surfaces which do not permanently dent or crack in normal usage, retaining the integrity of the furniture edges while providing desirable feel and cushioning. An elongated core of relatively hard material having an elongated cross-member and an elongated leg disposed in a plane perpendicular to the cross-member has a body of relatively soft, flexible material (such as polyurethane foam with a surface skin) molded around it. A portion of the core leg extends outwardly from the body and is disposed in a channel formed in an elongated narrow face of the piece of furniture. The surface skin of the body may be textured. When utilized with a desk, protection is further provided by forming the drawer fronts of sheet metal with thermoplastic foam molded around them, the molded drawer fronts matching the molded contour of bodies providing the desk front narrow faces.

13 Claims, 7 Drawing Figures

10
12
19
25
40
2
68
75
13
20
15
16
76
21
14

12
25
68
69
17
73
15
13
54
48

Fig. 3
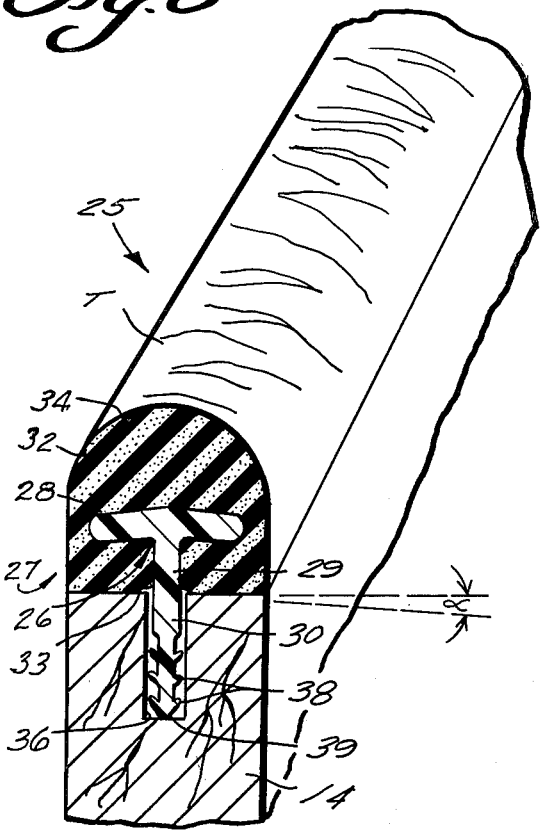
Fig. 4
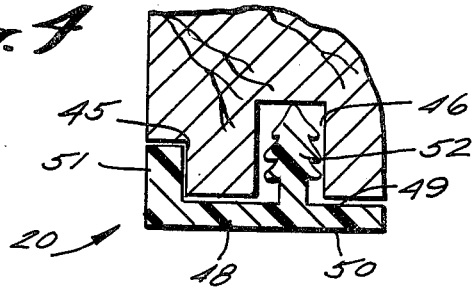
Fig. 6
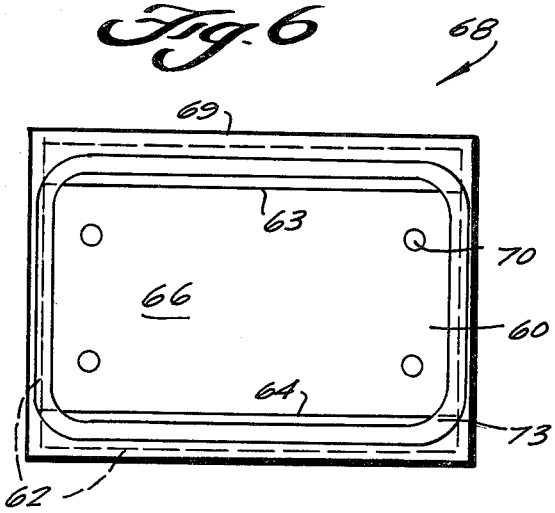
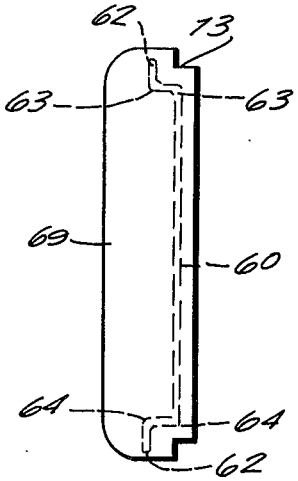
Fig. 5
Fig. 7
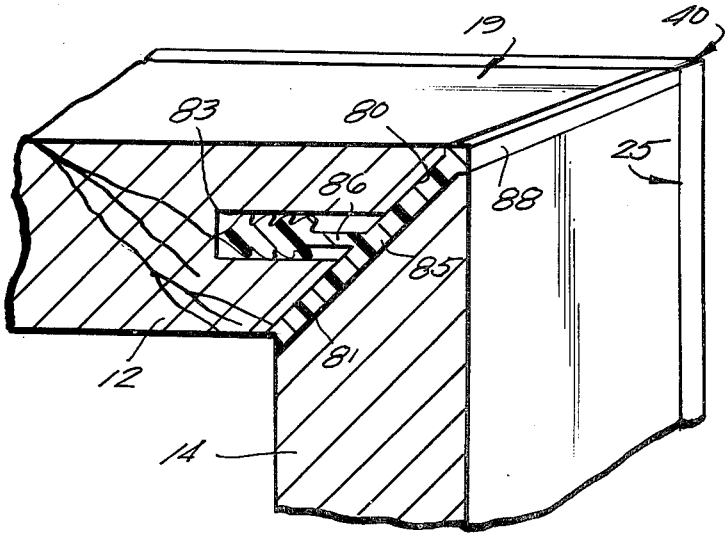

FLEXIBLE EDGING OF DESKS

BACKGROUND AND SUMMARY OF THE INVENTION

Conventional aesthetically pleasing pieces of furniture, especially furniture for office use such as desks, normally have exposed edges that may be readily cracked, dented, or chipped during the manufacturing and retailing processes, or during actual use. Chips, dents, and the like occurring during normal manufacturing processes require a great deal of time and expense in providing touchup, repair, etcetera. When such chipping, cracking, or the like occurs when the product is being shipped or retailed, oftentimes it is necessary to discount the product in order to sell it, and in any event the purchaser gets a less aesthetically pleasing product. Damage occurring during actual use decreases the desirability of the product. Also, exposed edges of office furniture in particular, whether chipped or not, can catch clothing or effect injury if the user impacts them with sufficient force.

In the past there have been various attempts to minimize damage to edges of furniture, and/or protect special users from injuring themselves on furniture edges. Such attempts have conventionally comprised adding bumper like structures to already existing products such as by tacking or gluing protective surfaces on preexisting edges, encompassing the edges (or narrow faces). Such prior attempts have not been universally successful, however, in providing protection, feel, and cushioning integrated in an aesthetically desirable system.

According to the present invention, the drawbacks inherent in the prior art are overcome, and aesthetically pleasing furniture, especially office furniture such as desks, is provided which has edge structures that will not chip, crack, or dent in normal usage, and have feel and cushioning properties associated therewith. The desired results are accomplished according to the present invention by constructing the edge configurations as a design feature of the product being produced so that a completely integrated system is provided with an end product requiring no tacking, gluing, or the like and with no aesthetically undesirable overhanging structures.

According to one aspect of the present invention, a method of constructing an assembly for providing an edge of a piece of furniture is provided. The method includes forming an elongated core of relatively hard material, such as vinyl, having an elongated cross-member disposed in a plane, and an elongated leg disposed in a plane extending substantially perpendicularly to the plane of the cross-member and integral therewith over substantially the entire length thereof. A body of relatively soft, flexible material, such as polyurethane foam, is then formed (preferably molded) around the core cross-member so that the cross-member is substantially completely encompassed by the flexible, relatively soft material with a portion of the leg extending outwardly from the body. The assembly is utilized in a method of forming surfaces of a piece of furniture having one or more elongated narrow faces by forming a channel along a narrow elongated face elongated in the same direction as the face, and affixing the assembly to the face by disposing the portion of the core leg extending outwardly from the body in the channel, and affixing it in the channel. Affixing is preferably accomplished by a press fit between the core leg and channel, and utilizing adhesive.

The invention also comprises a structure for providing an edge of a piece of furniture. The structure consists essentially of a core and body. The core is an elongated extrusion of relatively hard material (e.g. vinyl) having an elongated cross-member disposed in a plane, and an elongated leg disposed in a plane substantially perpendicular to the plane of the cross-member and integral therewith along a substantial portion of the length thereof. A body of relatively soft, flexible material (e.g. polyurethane foam) is molded around the core cross-member so that the cross-member is substantially completely encompassed by the flexible material with a portion of the leg extending outwardly from the body. The outwardly extending leg portion preferably has a plurality of projections extending outwardly therefrom along substantially the entire width thereof from both faces, and the end of the leg is pointed. The body preferably has a substantially flat face from which the leg portion of the core extends, and a curved face opposite the flat face. The surface skin of the body may be textured, such as to simulate a wood grain.

According to another aspect of the present invention, a method of forming all of the edge surfaces of a desk, or like piece of furniture, is provided to construct a desk completely free of veneer edge banding. The desk can be moved through the manufacturing process with a minimum amount of touch-up and edge break out, and once assembled it can travel through the manufacturing process with virtually no danger of dents or chipping due to handling errors. The desk will arrive at the dealer in much better condition than the average desk shipped to him, and the ultimate user will have an aesthetically pleasing product that will not experience edge chipping, cracking, or the like during normal usage, and which will have edges providing feel and cushioning upon touch and/or impact. The method includes forming a channel in each of three elongated narrow faces comprising the desk front with a plurality of drawers mounted within the area defined thereby, inserting a core and body assembly in operative association with each channel, and mitring the corners of the assembly so that they have smooth transitions with each other. The edging assembly is capable of being cut or sawed cleanly so that it can create an exact fit to conventional furniture (e.g. flakeboard) panels.

If desired, a desk may be further defined by a pair of edges extending along either side thereof between side panels and a top panel forming the desk, with protection provided for such edges between the top and side panels. This is accomplished by beveling edges of the top and side panels to provide coincident beveled faces, and forming a channel in one of the beveled faces, and forming an extrusion of flexible thermoplastic material (e.g. an ABS plastic extrusion). The extrusion includes a body portion having a pair of faces coextensive with the beveled panel faces, and an anchoring portion adapted to be inserted in the channel, and an end portion adapted to provide the actual exterior edge of the panels. The panels are assembled so that the beveled faces thereof are affixed to the coincident faces of the extrusion with the anchoring portion in the channel and with the end portion of the extrusion providing the actual exterior edge between the panels, flush with the panel faces.

According to yet another aspect of the present invention, drawers are provided for a desk or like piece of furniture compatible with the edging structures described above. In particular, structures adapted to form draw fronts are constructed by providing a piece of sheet metal having a pair of faces and a plurality of edges, and molding a thermoplastic or thermoset foam having a surface skin around one face and all the edges of the sheet metal. One face of the sheet metal is then attached to a drawer as the drawer front, adjacent the edging structures heretofore described and providing a smooth transition therewith.

It is the primary object of the present invention to provide a method and assembly for edging a piece of furniture, particularly office furniture such as a desk, so that it has only nonmarkable edges which provide protection, feel, and cushioning. This and other objects of the invention will become clear from an inspection of the detailed description of the invention, and from the appended claims.

BRIEF DESCRIPTION OF THE DRAWINGS

FIG. 3 is a detail view partly in cross-section and partly in elevation of an exemplary edge of the desk of FIG. 1 protected in accordance with the present invention;

FIG. 4 is a cross-sectional view of the botton narrow face of one of the side panels of the desk of FIG. 1;

FIG. 5 is a side view of a drawer front of the desk of FIG. 1;

FIG. 6 is a rear view of the drawer front of FIG. 5; and

FIG. 7 is a detail view, partly in cross-section and partly in elevation, showing an optional edge configuration at the juncture between a side and top panel of the desk of FIG. 1.

DETAILED DESCRIPTION OF THE INVENTION

Figure 1:
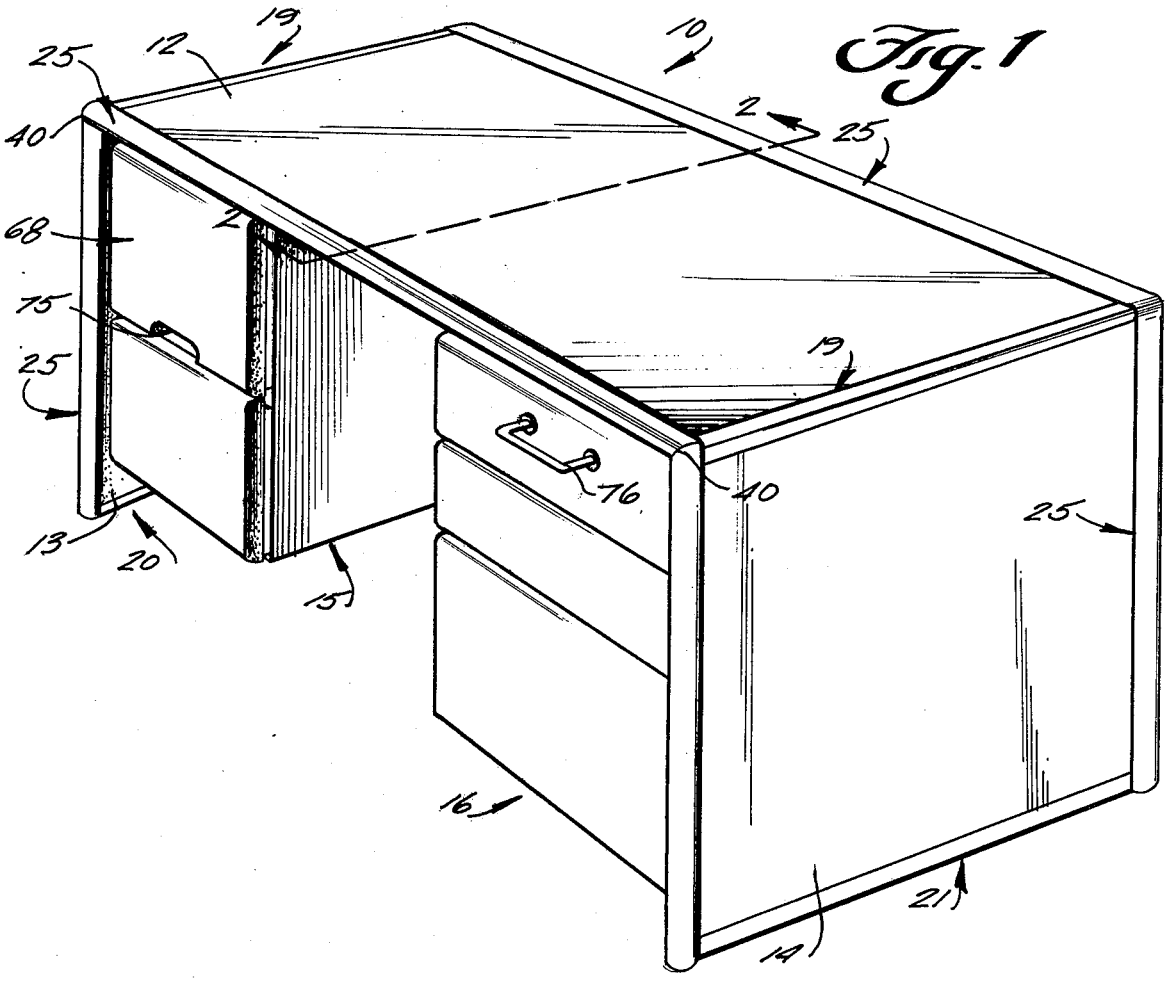
FIG. 1 is a perspective view of an exemplary desk constructed according to the teachings of the present invention.

An exemplary article of furniture constructed in accordance with the teachings of the present invention is illustrated generally at 10 in FIG. 1. The article of furniture illustrated is a desk, and the invention is best suited for the construction of office equipment, such as desks, although it is not limited to such use and can effectively be utilized in the construction of other pieces of furniture.

Figure 2:
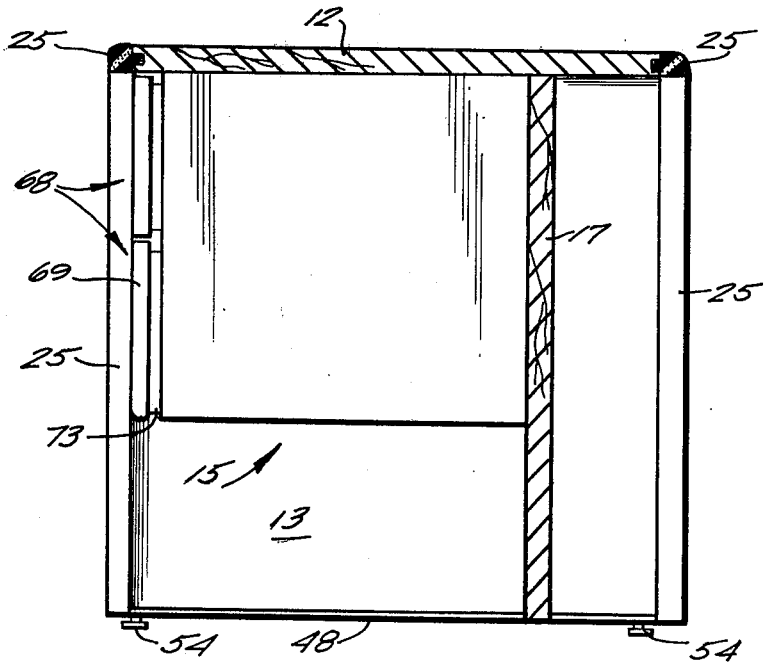
FIG. 2 is a cross-sectional view of the desk of FIG. 1 taken along lines 2—2 of FIG. 1.

The desk 10 has a basically conventional construction and is constructed from veneered panels (e.g. flakeboard panels), such as desks sold by JG Furniture Systems a division of Burlington Industries, Quakertown, Pennsylvania, under the trademark "REVEAL." The desk illustrated in FIGS. 1 and 2 has no veneer edge banding, in accordance with the present invention. The desk 10 includes a top panel 12, side panels 13 and 14, drawer assemblies 15 and 16, and a modesty panel 17. Three elongated narrow faces of the panels 12, 13, and 14 respectively define the front of the desk 10, and another three such faces define the back of the desk (see FIG. 2). The drawer assemblies 15, 16 are mounted within the area defined by the elongated narrow faces, adjacent such faces. The desk 10 may be further defined by a pair of edges illustrated generally by reference numeral 19 along either side thereof between a side panel (13, 14) and the top panel 12. A narrow face extends along the bottom of each of the side panels 13, 14, as illustrated generally at 20 and 21 in the drawings.

According to the present invention, the narrow faces of the panels 12, 13, 14 defining the front and back of the desk 10 have a protecting edge assembly as an integral design element thereof. Such assemblies, illustrated most clearly in FIGS. 1 through 3, are designated by the general reference numeral 25 and include a core element 26 and a body element 27 (see FIG. 3 in particular). The core 26 is formed of relatively hard material such as hard plastic, metal, or the like, with a hard plastic such as vinyl being preferred. Preferably the core 26 is an extrusion of hard plastic, and includes an elongated cross-member 28 disposed in a plane, and an elongated leg 29 disposed in a plane substantially perpendicular to the plane of the cross-member 28 and integral therewith over substantially the entire length thereof. The leg 29 is substantially perpendicular to the cross-member 28, and as illustrated in FIG. 3 preferably the core 26 has a T-shaped cross-section. The cross-member need not be completely flat, but rather the ends thereof may slant downwardly from a true perpendicular to the leg 29, as illustrated in FIG. 3.

The body 27 of the edging assembly 25 is formed (e.g. molded) of relatively soft, flexible material, around the cross-member 28 so that the cross-member 28 is completely encompassed thereby. A portion 30 of the leg 29 extends outwardly from the body 27. The term "relatively soft, flexible material" as used in the present specification and claims means a material that has "give" in its end use, yet will return to its normal position after impact and will not permanently dent, chip, or crack in normal usage. A particularly desirable material is thermoplastic foam, such as self-skinning polyurethane foam having a surface skin 32 inherently formed during the molding process. A polyurethane foam having an average density of 16.454 pounds per cubic foot is particularly desirable, although materials having a relatively large variation from such density are suitable for practicing the present invention.

The body 27, as illustrated most clearly in FIG. 3, preferably includes a face 33 thereof that is substantially flat, being substantially perpendicular to the leg 29 and from which the leg portion 30 extends, and being substantially parallel to the cross-member 28. Opposite the face 33 the body 27 includes a rounded exterior face 34. The face 33 is adapted to abut the elongated narrow face of a panel (e.g. panel 14 in FIG. 3) with the surface 34 being exterior. Although the face 33 is substantially flat, preferably a small clearance is provided between it and the abutting face of the panel 14 by providing a taper of angle (see FIG. 3) for each portion of face 33 extending outwardly from leg 29. Angle may be about 7°.

Preferably the core 26 extends the entire length of the body 27, although under some circumstances segments of core 26 may be provided at spaced intervals along the length of the body 27.

In order to enhance the aesthetic effects of the assemblies 25, the surface skin 32 of the body may be textured. This may be accomplished by forming surface manifestations on the interior of the mold in which the core 26 is placed and the relatively soft, flexible material inserted. Such surface manifestations may be provided so as to provide a texture T (see FIG. 3) simulating a wood grain, a so-called "hair cell" texture, or other desirable decorative effect.

The leg portion 30 of the assembly 25 is adapted to cooperate with a channel 36 formed in the panel (e.g. panel 14 in FIG. 3) with which it is associated. The channel is elongated in the same direction as the face of the panel with which it cooperates. Preferably the leg portion 30 has a plurality of projections or serrations 38 extending outwardly therefrom along substantially the entire width thereof, and from both faces thereof, and the end of the portion 30 remote from the body 27 is pointed as indicated at 39. A preferred manner of securing the assembly 25 to a panel (e.g. panel 14) is by providing a press fit between leg portion 30 (projections 38 thereof) and channel 36, and by providing an adhesive in the channel 36.

The assembly 25 is capable of readily being cut or sawed cleanly after construction thereof so that an exact fit can be provided to flakeboard panels, particularly where mitre cuts are necessary. For instance mitres 40, as illustrated particularly in FIG. 1, are readily formed so that the assemblies 25 have smooth transitions with each other.

The bottom narrow faces 20, 21 of the side panels 13, 14 preferably are also provided with protecting structures, as illustrated most clearly in FIG. 4. This is accomplished by forming a cutout 45 at the exterior corner of the side panel (panel 13 in FIG. 4) substantially along the entire extent thereof, and forming a channel 46 in the side panel bottom parallel to the cutout 45, and substantially along the entire extent of the bottom 20. An edge protector is provided, the edge protector preferably comprising an extrusion of rigid thermoplastic material such as ABS plastic. The edge protector includes a body portion 48 with a pair of opposite flat faces 49, 50, and an end portion 51 extending perpendicularly to the body portion 48 and adapted to fit the cutout 45 in the side panel exterior bottom corner, and an anchoring portion 52 extending parallel to the end portion 51 and shaped to fit the bottom channel 46. The end portion 51 is inserted in the cutout 45 and the anchoring portion 52 is inserted in channel 46, and they are affixed in place to provide the edge protector substantially along the entire bottom and exterior bottom corner of the side panel 13. Affixing can be accomplished by a press fit and adhesive. The bottom face 50 of the protector body 48 may provide the bottom of the desk 10, or conventional floor glides 54 (see FIG. 2) may be utilized.

The desk 10 also is preferably constructed so that the drawer fronts of the drawer assemblies 15, 16 are covered with flexible, relatively soft, material. This is accomplished by taking a metal sheet 60 or the like (see FIGS. 5 and 6 in particular) having a pair of opposite faces and a plurality of edges 62 defining the faces. The metal sheet also preferably has the contour illustrated in FIG. 5, including bends at 63 and 64. The sheet 60 is placed in a mold and a thermoplastic foam (e.g. polyurethane foam such as is used for the edge assemblies 25) is molded around the sheet 60 to cover at least one face and all edges 62 of the sheet 60, providing a final drawer front assembly 68. The polyurethane foam, shown generally at 69 in the drawings, has a surface skin.

The face 66 (which may be covered, or uncovered as illustrated in FIG. 6) is adapted to be connected to a drawer structure so that the assembly 68 provides a drawer front. For instance a plurality of screw threaded holes 70 may be provided in metal sheet 60 through which screws extend from a conventional drawer structure.

In the molding process, a lip 73 having a smaller area than the rest of the foam body 69 may be provided, the difference in area between the lip 73 and foam body 69 providing an area which the user may grasp to readily open a drawer fronted by drawer front 68 (see FIG. 2). While this is the preferred manner of providing for ready drawer opening, if desired hand grasping portions such as illustrated at 75 in FIG. 1 may be molded in the foam body 69, or a conventional handle 76 can be attached to the drawer front.

Edge protection may be provided if desired for the edges 19 of the desk 10, although that is not normally desirable. A manner in which edge protection may be provided for the edges 19 is illustrated most clearly in FIG. 7.

The panels forming the edge 19 (e.g. panels 12 and 14 in FIG. 7) have coincident beveled faces 80, 81 formed thereon, and a channel 83 is formed in one of the faces (e.g. face 80 in FIG. 7). An extrusion of rigid thermoplastic material, such as ABS plastic, is formed to cooperate with the faces 80, 81 and the channel 83. The extrusion includes an elongated body portion 85 with opposite faces substantially coextensive with the beveled faces 80, 81 (as illustrated in FIG. 7), and the body portion 85 has an anchoring portion 86 extending outwardly from one of the faces thereof. The body portion 85 also includes an end portion 88 that is adapted to provide the actual exterior edge between the panels 12, 14.

In forming an edge 19, the extrusion is placed so that anchoring portion 86 extends into channel 83 and so that faces 80, 81 are in face-to-face engagement with the opposite faces of the extrusion body portion 85. The elements are affixed together in this relationship by suitable means, such as adhesive applied between the various components. The end portion 88 of the extrusion body 85 provides the actual exterior edge between the exterior faces of the panels 12, 14, being flush therewith.

It will thus be seen that according to the present invention methods and assemblies have been provided that take the edge structures of an article of furniture into account as an important design feature of the furniture. Furniture produced according to the present invention, such as a desk, has no veneer edge banding, yet is aesthetically pleasing and can be moved through the manufacturing process with a minimum amount of touch up and edge break out, and once assembled there will be virtually no danger of dents or chips due to handling errors. Once assembled no further finishing is required. The edge structures of the article of furniture produced have give, yet will return to their original shape in normal usage, and will not dent, crack, chip, or the like. In addition to providing protection, the edge structures at the furniture article front (and the drawer fronts) provide feel and cushioning, providing a high quality end product.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and assemblies.

What is claimed is:

1. A structure providing a protective edge of a piece of furniture and distinct from structural components of the piece of furniture, said structure consisting essentially of:

a core consisting essentially of an elongated member of relatively hard, rigid material having an elongated cross-member disposed in a plane, and an elongated leg disposed in a plane substantially perpendicular to the plane of said cross-member and integral therewith along substantially the entire length thereof; and an elongated body of relatively soft, flexible material, formed around the core cross-member so that the cross-member is substantially completely encompassed by the flexible, relatively soft material, with at least a portion of the leg extending outwardly from the body and attached to structural components of the piece of furniture;

said elongated core and body being substantially coextensive along their entire length.

2. A structure as recited in claim 1 wherein the leg of the core has a plurality of projections extending outwardly therefrom along substantially the entire dimension thereof coextensive with the cross-member dimension of elongation, the projections extending outwardly from both faces thereof, and wherein the end of the leg portion extending outwardly from the body is pointed.

3. A structure as recited in claim 1 or 2 wherein the body has a substantially flat face from which the leg portion of the core extends, the flat face being substantially parallel to the core cross-member, and wherein the body has a curved face opposite the flat face.

4. A structure as recited in claim 3 wherein the core is a vinyl extrusion, and wherein the body is made of polyurethane foam molded around the core, and having a surface skin.

5. A structure as recited in claim 3 wherein the body is made of thermoplastic foam having a surface skin having decorative exterior surface manifestations formed thereon.

6. A structure as recited in claim 3 wherein the body is made of thermoplastic foam having a surface skin textured to simulate a wood grain, a hair cell texture, or like decorative effect.

7. A structure as recited in claim 3 wherein the leg is substantially perpendicular to to the flat face.

8. A structure as recited in claim 1 wherein the core is a vinyl extrusion, and wherein the body is made of polyurethane foam molded around the core, and having a surface skin.

9. A structure as recited in claim 1 wherein the body is made of thermoplastic foam having a surface skin having decorative exterior surface manifestations formed thereon.

10. A structure as recited in claim 1 wherein the body is made of thermoplastic foam having a surface skin textured to simulate a wood grain.

11. A structure as recited in claim 1 wherein the cross-member extends on both sides of the leg.

12. A structure as recited in claim 11 wherein the cross-member and leg have a T-shaped cross-section.

13. A structure as recited in claim 1 wherein the core is made of metal.

* * * * *